US011845046B2

(12) United States Patent
Stephenson et al.

(10) Patent No.: US 11,845,046 B2
(45) Date of Patent: Dec. 19, 2023

(54) MIXING SYSTEM AND METHOD OF USING THE SAME

(71) Applicant: Industrial Dielectrics, Inc., Noblesville, IN (US)

(72) Inventors: Mark Stephenson, Fairland, IN (US); Christopher Templin, Noblesville, IN (US)

(73) Assignee: Industrial Dielectrics, Inc., Noblesville, IN (US)

( * ) Notice: Subject to any disclaimer, the term of this patent is extended or adjusted under 35 U.S.C. 154(b) by 336 days.

(21) Appl. No.: 17/064,795

(22) Filed: Oct. 7, 2020

(65) Prior Publication Data

US 2021/0101122 A1 Apr. 8, 2021

Related U.S. Application Data

(60) Provisional application No. 62/912,243, filed on Oct. 8, 2019.

(51) Int. Cl.

| | |
|---|---|
| ***B01F 23/00*** | (2022.01) |
| ***B01F 23/50*** | (2022.01) |
| ***B01F 35/21*** | (2022.01) |

(52) U.S. Cl.

CPC ..... *B01F 23/59* (2022.01); *B01F 35/2111* (2022.01); *B01F 35/2134* (2022.01)

(58) Field of Classification Search

CPC ..... B01F 23/59; B01F 35/2134

See application file for complete search history.

(56) References Cited

U.S. PATENT DOCUMENTS

| | | | | |
|---|---|---|---|---|
| 6,327,914 | B1 | 12/2001 | Dutton | |
| 7,056,008 | B2 | 6/2006 | Rondeau | |
| 7,497,130 | B2 * | 3/2009 | Woods | G01F 15/18 73/861.357 |
| 8,677,833 | B2 | 3/2014 | Kahle | |
| 10,620,027 | B2 | 4/2020 | Schollenberger | |
| 2005/0124499 | A1 * | 6/2005 | Shinbach | C09K 8/03 507/100 |
| 2008/0212397 | A1 | 9/2008 | Rondeau | |
| 2017/0259457 | A1 | 9/2017 | Chong | |

FOREIGN PATENT DOCUMENTS

| | | | |
|---|---|---|---|
| CN | 2593163 | Y | 12/2003 |
| CN | 203824597 | U | 9/2014 |
| WO | 2016140734 | A1 | 9/2016 |

* cited by examiner

*Primary Examiner* — Anshu Bhatia

(74) *Attorney, Agent, or Firm* — BARNES & THORNBURG LLP

(57) ABSTRACT

A mixing system is configured to mix and discharge a paste. The mixing system includes a base-medium subsystem that provides a base fluid-medium. The mixing system further includes an additive-medium subsystem that provides one or more additive fluid-mediums. The mixing system further includes a density-reducing medium subsystem that provides a density-reducing medium.

7 Claims, 3 Drawing Sheets

MIXING SYSTEM AND METHOD OF USING THE SAME

PRIORITY CLAIM

This application claims priority under 35 U.S.C. § 119(e) to U.S. Provisional Application Ser. No. 62/912,243, filed Oct. 8, 2019, which is expressly incorporated by reference herein.

BACKGROUND

The present disclosure relates to a mixing system, and particularly to mixing system configured to transfer and mix a paste. More particularly, the present disclosure relates to a mixing system that is configured to inject a density-reducing medium into a base fluid-medium.

SUMMARY

A mixing system, in accordance with the present disclosure, includes a base-medium subsystem, an additive-medium subsystem, and a density-reducing medium subsystem. The base-medium system is configured to mix one or more units of a base fluid-medium and transport the base fluid-medium along a conveyor to a product assembly line. The additive-medium subsystem is configured to inject one or more additive fluid-mediums into the base fluid-medium. The density-reducing medium subsystem is configured to inject a density reducing medium into the base fluid medium to decrease an overall density of the total composition of mediums prior to the composition of mediums reaching the product assembly line.

In illustrative embodiments, the base medium subsystem includes the conveyor, a high-shear mixer coupled to a first end of the conveyor, and a low-shear dynamic mixer coupled to an opposite, downstream end of the conveyor. The high-shear mixer is configured to provide a first shear rate with the base fluid-medium during operation. The dynamic mixer is configured to provide a second shear rate with the total composition of mediums. The second shear rate is lower than the first shear rate so that any shear-sensitive mediums added to the base fluid-medium are not damaged or adversely affected prior to reaching the product assembly line.

In illustrative embodiments, the density-reducing subsystem is configured to inject a plurality of glass microspheres into the base fluid-medium downstream of the high-shear mixer and upstream of the dynamic mixer. The density-reducing subsystem includes a conveyor coupled to the conveyor of the base-medium subsystem, a pump configured to displace the plurality of glass microspheres for transportation through the conveyor to the base fluid medium, and a flow meter configured to measure the amount of glass microspheres flowing through the conveyor and being injected into the base fluid-medium. The glass microspheres may be similar to a powder that has flow properties similar to a fluid when displaced by the pump. The flow meter is a Coriolis flow meter to measure the fluidized glass microspheres so that a predetermined amount of glass microspheres is injected into the base fluid-medium to provide a desired, predetermined density of the base fluid-medium.

BRIEF DESCRIPTIONS OF THE DRAWINGS

Figure 1:
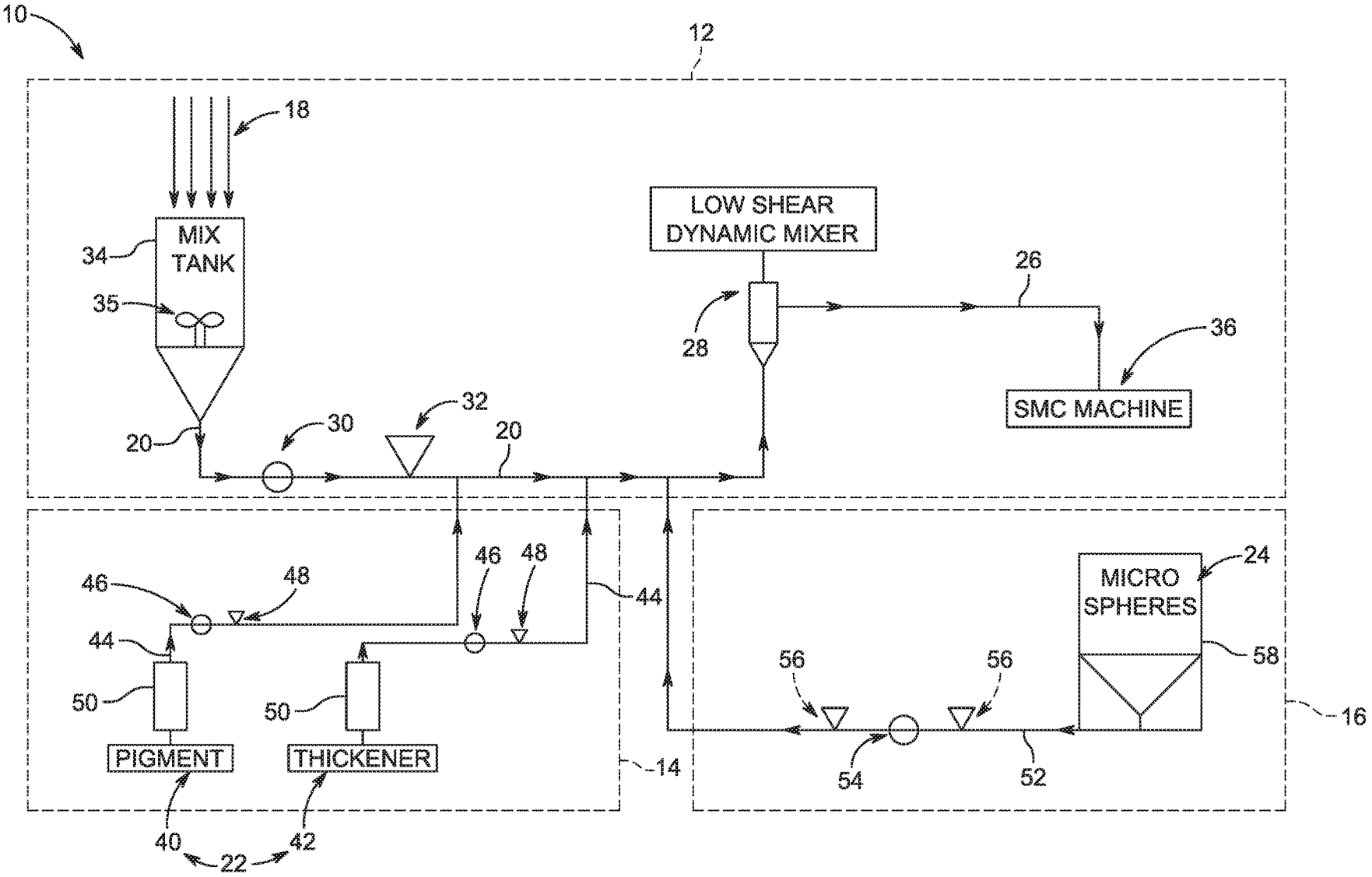
Figure 2:
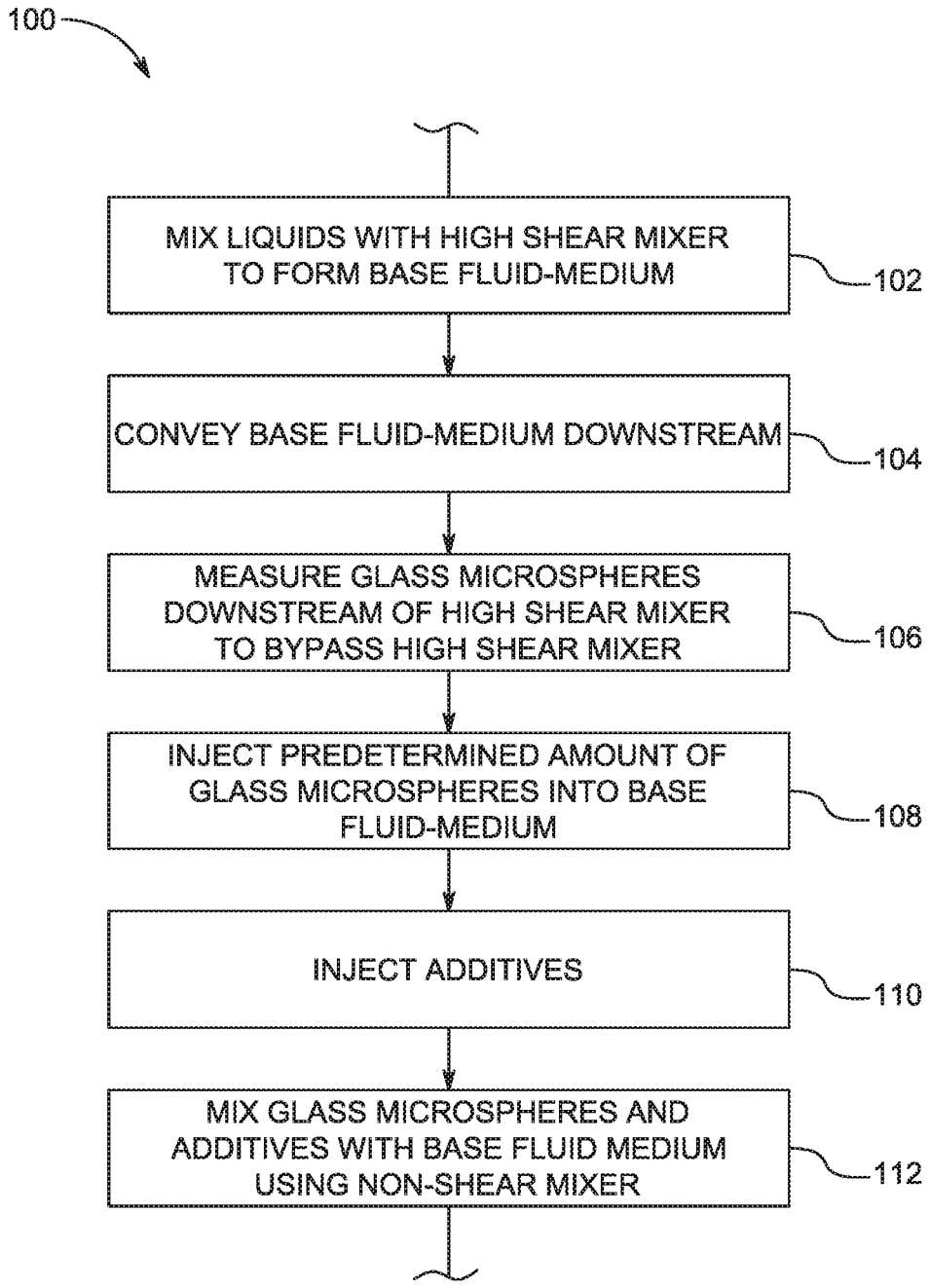
Figure 3:
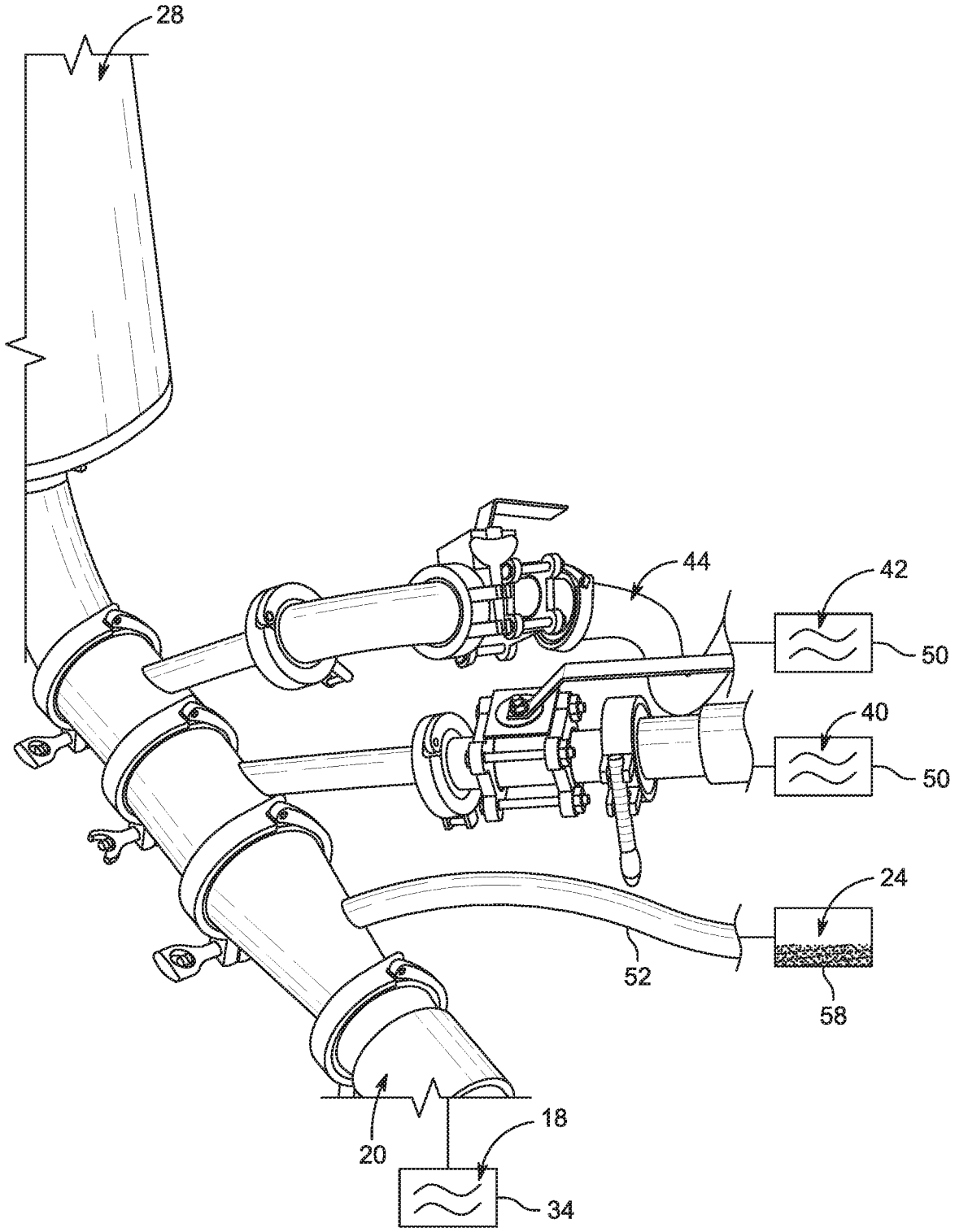

The detailed description particularly refers to the accompanying figures in which:

FIG. 1 is a diagrammatic view of a mixing system in accordance with the present disclosure showing that the mixing system is configured to receive and mix a base fluid-medium, one or more additive fluid-mediums, and a density-reducing medium;

FIG. 2 is diagrammatic flow chart of a process of measuring an amount of the density-reducing medium being injected into the base fluid-medium without exposing the density-reducing medium to a high shear mixer; and FIG. 3 is a perspective view of a portion of a conveyor and a plurality of injection ports where the additive fluid medium and the density-reducing medium are injected into the base fluid-medium downstream of a high shear mixer so that the density-reducing medium bypasses the high shear mixer.

DETAILED DESCRIPTION

A mixing system 10 in accordance with the present disclosure includes a base-medium subsystem 12, an additive-medium subsystem 14, and a density-reducing medium subsystem 16 as shown in FIGS. 1 and 2. The base-medium subsystem 12 is configured to receive and transport a base fluid-medium 18 along a conveyor 20. The additive-medium subsystem 14 is configured to inject one or more additive fluid-mediums 22 to the base fluid-medium 18. The density-reducing medium subsystem 16 is configured to inject a plurality of glass microspheres 24 into the base fluid-medium 18. Some examples of suitable glass microspheres include K Series, S Series, and iM Series Glass Bubbles manufactured by 3M™.

Once fully mixed, the base-fluid medium 18, the one or more additive fluid-mediums 22, and the plurality of glass microspheres 24 form a paste 26 that can be used in a product assembly line, such as a sheet molding compound (SMC) machine as suggested in FIG. 1. The plurality of glass microspheres 24 are configured to reduce the density of the base-fluid medium 18 so that less paste 26 is needed per unit of SMC.

The base-medium subsystem 12 includes the conveyor 20, a dynamic mixer 28, a pump 30, and a flow meter 32 as shown in FIG. 1. The conveyor 20 is illustratively embodied as a tubular conduit that transports the base-fluid medium 18 from one or more storage tanks 34 to a SMC manufacturing machine 36. The additive fluid-medium 22 and the plurality of glass microspheres 24 are injected into the base fluid-medium 18 in the conveyor 20 downstream of the storage tanks 34. The dynamic mixer 28 is a low-shear mixer and is configured to blend the base fluid-medium 18, the additive fluid-medium 22, and the plurality of glass microspheres 24 before the paste is delivered to the SMC manufacturing machine 36. The pump 30 is configured to create suitable head sufficient to convey the base fluid-medium 18 from the storage tank 34 to the SMC manufacturing machine 36. The flow meter 32 is a Coriolis flow meter and is configured to measure a mass flow of the base fluid-medium 18 flowing through the conveyor 20.

In the illustrative embodiment, the additive-medium subsystem 14 is configured to inject at least one additive fluid medium 22, such as a pigment 40 and a thickener 42, into the base fluid medium 18. However, in some embodiments, the additive-medium subsystem 14 may inject any number of additive fluid-mediums 22 into the base fluid-medium 18 as suggested in FIG. 1. The additive-medium subsystem 14 includes a conveyor 44, a pump 46, and a flow meter 48 for each additive fluid-medium 22 that is injected into the base fluid-medium 18. In some embodiments, two or more additive fluid mediums 22 may share a common conveyor 44, pump 46, and/or flow meter 48. Each conveyor 44 is illustratively embodied as a tubular conduit that transports the additive fluid-medium 22 from one or more additive storage tanks 50 to the conveyor 20 where the additive fluid-medium 22 is injected into the base fluid-medium 18. Each pump 46 is configured to create suitable head sufficient to convey the additive fluid-medium 22 from the storage tank(s) 50 to the conveyor 20. Each flow meter 48 is a Coriolis flow meter and is configured to measure a mass flow of the additive fluid-medium 22 flowing through each conveyor 44.

The density-reducing medium subsystem 16 injects the plurality of glass microspheres 24 into the base fluid-medium 18 downstream of the storage tank 34 and upstream of the dynamic mixer 36 as shown in FIG. 1. The density-reducing medium subsystem 16 includes a conveyor 52, a pump 54, and a flow meter 56. The conveyor 52 is illustratively embodied as a tubular conduit that transports the plurality of glass microspheres 24 from one or more storage tanks 58 to the conveyor 20 where the plurality of glass microspheres 24 are injected into the base fluid-medium 18. The pump 46 is configured to aerate the plurality of glass microspheres such that they act as a fluid as they travel through the conveyor 52. The pump 54 is also configured to create suitable head sufficient to convey the plurality of glass microspheres 24 from the storage tank(s) 58 to the conveyor 20. An example of a suitable pump 54 is the Husky™ 1050e Electric-Operated Diaphragm Pump manufactured by GRACO®. The flow meter 56 is a Coriolis flow meter and is configured to measure a mass flow of the plurality of glass microspheres 24 flowing through the conveyor 54. In some embodiments, another type of a density-reducing medium may be used and injected using the density-reducing medium subsystem 16.

In some embodiments, glass microspheres are added to a base fluid-medium and mixed with the base fluid-medium using a high-shear mixer 35. In these embodiments, the mixing using the high shear mixer 35 is typically done upstream of the flow meter 32. However, because of the high-shear mixer 35, a relatively high amount of the glass microspheres may become damaged during the mixing (i.e. greater than 10%). This could limit their ability to reduce the density of the base fluid-medium and make it difficult to determine the appropriate amount of glass microspheres desired to reduce the density of the base fluid-medium. In one example, the high-shear mixer 35 is a first mixer of the mixing system 10 and is configured to provide a first shear rate. The dynamic mixer 28 is a second mixer of the mixing system 10 and is configured to provide a second shear rate lower than the first shear rate.

In the illustrative embodiment, the Coriolis flow meter 56 is positioned upstream or downstream of the pump 54 as suggested in FIG. 1. The flow meter 56 is configured to accurately measure a mass flow of the plurality of microspheres 24 to determine an amount of glass microspheres 24 added to the base fluid-medium 18. The flow meter 56 enables a user to provide a predetermined amount of glass microspheres 24 into the base fluid-medium 18 to reduce the density of the base fluid-medium 18 by a predetermined, predictable amount. The glass microspheres 24 are injected into the base fluid medium downstream of the storage tank 34 and the high shear mixer 35 such that the glass microspheres 24 are exposed to little or no shear in the mixing system 10. Accordingly, a relatively low amount of the glass microspheres 24 are damaged in the mixing system 10. In one example, less than 10% of the glass microspheres 24 are damaged in the mixing system 10. An example of a suitable flow meter 56 is the TCM 028K Coriolis Mass Flow Meter, manufactured by TRICOR® Coriolis Technology.

A method 100 of measuring the glass microspheres 24 and mixing the glass microspheres 24 into a base fluid-medium 18 is shown diagrammatically in FIG. 2. At a first step 102, one or more liquids are mixed in the storage tank 34 with a high shear mixer to form the base fluid-medium 18. At a step 104, the base fluid-medium is conveyed from the storage tank 34 downstream through the conveyor 20. At a step 106, the plurality of glass microspheres 24 are measured using the Coriolis flow meter 56 downstream of the high shear mixer to bypass the high shear mixer. At a step 108, a predetermined amount of glass microspheres 24, measured in step 106, is injected into the base fluid-medium 18 in the conveyor 20. At a step 110, the one or more additive fluid-mediums 22 are injected into the base fluid-medium 18 in the conveyor 20. The additive fluid-mediums 22 and the plurality of glass microspheres are injected into the base fluid-medium 18 upstream of the dynamic mixer as shown in FIG. 3. At a step 112, the glass microspheres 24 and the additive fluid-medium(s) 22 are mixed with the base fluid-medium 18 using a dynamic mixer. The dynamic mixer creates little or no shear so that at least 90% of the glass microspheres survive the mixing process and provide the desired density of the paste.

The invention claimed is:

1. A method of measuring glass microspheres and mixing the glass microspheres into a base fluid-medium, the method comprising conveying the base fluid-medium from a storage tank to a product assembly line, measuring an amount of glass microspheres with a Coriolis flow meter to determine a predetermined amount of glass microspheres, injecting the predetermined amount of glass microspheres into the base fluid-medium to provide a desired, predetermined density of the base fluid-medium, mixing the base fluid-medium with a first mixer prior to injecting the glass microspheres into the base fluid-medium, and mixing the base fluid-medium and the glass microspheres with a second mixer after injecting the glass microspheres into the base fluid-medium.

2. The method of claim 1, wherein the first mixer is a high-shear mixer configured to provide a first shear rate and the second mixer is a dynamic mixer configured to provide a second shear rate lower than the first shear rate.

3. The method of claim 1, further comprising a step of pumping the glass microspheres to the base fluid-medium with a pump.

4. The method of claim 3, wherein the pump is upstream of the Coriolis flow meter.

5. The method of claim 3, wherein the pump is downstream of the Coriolis flow meter.

6. The method of claim 1, further comprising a step of injecting at least one additive medium into the base fluid-medium.

7. The method of claim 6, wherein the at least one additive medium is injected into the base fluid-medium downstream of the glass microspheres.

* * * * *